US008803778B2

(12) United States Patent
Kim

(10) Patent No.: US 8,803,778 B2
(45) Date of Patent: Aug. 12, 2014

(54) LIQUID CRYSTAL DISPLAY DEVICE CAPABLE OF REDUCING NUMBER OF OUTPUT CHANNELS OF DATA DRIVING CIRCUIT

(75) Inventor: Hyunchul Kim, Gyeongbuk (KR)

(73) Assignee: LG Display Co., Ltd., Seoul (KR)

( * ) Notice: Subject to any disclaimer, the term of this patent is extended or adjusted under 35 U.S.C. 154(b) by 238 days.

(21) Appl. No.: 13/313,222

(22) Filed: Dec. 7, 2011

(65) Prior Publication Data

US 2012/0146964 A1 Jun. 14, 2012

(30) Foreign Application Priority Data

Dec. 10, 2010 (KR) ..... 10-2010-0126539

(51) Int. Cl.
*G09G 3/36* (2006.01)

(52) U.S. Cl.
USPC ..... 345/94; 345/99

(58) Field of Classification Search
USPC ..... 345/87–104, 211–213
See application file for complete search history.

(56) References Cited

U.S. PATENT DOCUMENTS

| | | | | |
|---|---|---|---|---|
| 2004/0104880 | A1 * | 6/2004 | Kang et al. | 345/94 |
| 2005/0083356 | A1 | 4/2005 | Roh et al. | |
| 2007/0090347 | A1 * | 4/2007 | Park et al. | 257/40 |
| 2007/0097046 | A1 * | 5/2007 | Choi | 345/82 |
| 2007/0097057 | A1 * | 5/2007 | Shin | 345/98 |
| 2008/0129652 | A1 | 6/2008 | Park | |
| 2010/0053059 | A1 * | 3/2010 | Kim et al. | 345/99 |
| 2010/0149151 | A1 * | 6/2010 | Nam et al. | 345/211 |

FOREIGN PATENT DOCUMENTS

| | | | |
|---|---|---|---|
| EP | 0 368 572 | B1 | 8/1995 |
| JP | 2005-122179 | A | 5/2005 |
| KR | 10-2007-0006281 | A | 1/2007 |
| KR | 10-2007-0120269 | A | 12/2007 |

OTHER PUBLICATIONS

Korean Office Action dated Dec. 20, 2012 for corresponding Korean Paten Application No. 10-2010-0126539.
Office Action dated Oct. 21, 2013 from the German Patent and Trademark Office in counterpart German application No. 10-2011-056-251.6.

* cited by examiner

*Primary Examiner* — Chanh Nguyen
*Assistant Examiner* — Sanghyuk Park
(74) *Attorney, Agent, or Firm* — Morgan, Lewis & Bockius LLP

(57) ABSTRACT

A liquid crystal display device comprises: a display panel having a pixel array comprising a first group of cells and a second group of cells and configured to share data lines with cells of the first group adjacent in extension direction of the gate lines; a data driving circuit comprising a latch array, wherein the latch array temporally separates first group data to be applied to the liquid crystal cells of the first group and second group data to be applied to the liquid crystal cells of the second group according to data rendering control signals, and outputs the first group data earlier by about ½ horizontal period than the second group data.

12 Claims, 8 Drawing Sheets

LIQUID CRYSTAL DISPLAY DEVICE CAPABLE OF REDUCING NUMBER OF OUTPUT CHANNELS OF DATA DRIVING CIRCUIT

This application claims the benefit of Korean Patent Application NO. 10-2010-0126539 filed on Dec. 10, 2010, the entire contents of which is incorporated herein by reference for all purposes as if fully set forth herein.

BACKGROUND

1. Field

This document relates to a liquid crystal display device which can reduce the number of output channels of a data driving circuit.

2. Related Art

An active matrix driving type liquid crystal display displays moving pictures by using a thin film transistor (hereinafter, "TFT") as a switching element. Since such LCDs can be made smaller than cathode ray tubes, they have been applied to various displays of mobile information devices, office machines, computers, televisions, etc. Liquid crystal cells of a liquid crystal display displays picture images by changing transmittance according to a potential difference between a data voltage supplied to a pixel electrode and a common voltage supplied to a common electrode.

Measures for changing the connection configuration of liquid crystal cells of a liquid crystal display panel are continuously being implemented to reduce the number of output channels of a data driving circuit in a liquid crystal display device. FIG. 1 shows the comparison between a typical normal panel and a double rate driving (DRD) panel for reducing the number of output channels.

The normal panel as shown in (A) of FIG. 1 realizes a horizontal resolution of 800 using 2400 (800*3(RGB)) data lines DL. Since output channels of the data driving circuit are connected to the data lines DL in one-to-one correspondence, the data driving circuit for driving the normal panel requires 2400 output channels.

The DRD panel as shown in (B) of FIG. 1 can realize a horizontal resolution of 800 using only 1200 data lines DL because a pair of adjacent left and right liquid crystal cells with a data line DL interposed therebetween shares the data line DL. That is, the pair of liquid crystal cells sharing the same data line DL are adjacent in an extension direction of the gate lines. Accordingly, the number of output channels of the data driving circuit for driving the DRD panel is reduced to 1200 which is half the number of output channels shown in (A) of FIG. 1.

However, the DRD panel has a panel rendering structure in which the liquid crystal cells sharing the data line DL receive data in a time-division manner. Thus, a timing controller has to change an alignment sequence of video data in accordance with this panel rendering structure. This will be explained concretely with reference to FIG. 2.

In general, the input sequence of video data input to the timing controller from a system board is in agreement with the normal panel rendering structure as shown in (A) of FIG. 1. In this case, the timing controller synchronizes the output sequence of the video data with the input sequence thereof from the system board as shown in (A) of FIG. 2. That is, the timing controller outputs video data for one horizontal line to the data driving circuit in the order of R0, G0, B0, R1, G1, B1, . . . , R799, G799, B799.

On the other hand, in the DRD panel rendering structure as shown in (B) of FIG. 1, the writing sequence of video data is in accord with the illustrated arrow directions. Thus, the timing controller has to align video data input from a system in the order of R0, G0, B0, R1, G1, B1, . . . R799, G799, B799 in accordance with the data writing sequence indicated by the arrow directions. The timing controller time-divides 1 horizontal period for applying video data for 1 horizontal line, and respectively aligns pre-charge data for ½ horizontal line to be written first in the order and post-charge data for ½ horizontal line to be written later in the order. The timing controller aligns the pre-charge data in the order of R0, R1, B1, R2, R3, B3, . . . R796, R797, B797, R798, R799, B799, and then outputs the pre-charge data to the data driving circuit in this alignment sequence during the first half of the horizontal period. The pre-charge data comprises all the red (R) data R0, R1, R2, R3, . . . R796, R797, R798, R799, and one half odd-numbered blue (B) data B1, B3, B797, B799, both of which are to be written within the one horizontal period. The timing controller aligns the post-charge data in the order of G0, B0, G1, G2, B2, G3, . . . , G796, B796, G797, G798, B798, G799, and then outputs the post-charge data to the data driving circuit in this alignment sequence during the second half of the horizontal period. The post-charge data comprises all the green (G) data G0, G1, G2, G3, . . . G796, G797, G798, G799 and the other half even-numbered blue (B) data B0, B2, . . . B796, B798, both of which are to be written within the horizontal period.

As such, a liquid crystal display device having a DRD panel necessarily requires a line memory for storing input video data for each horizontal line as shown in FIG. 3 because the alignment sequence of video data has to be changed in accordance with the panel rendering structure. This causes cost increase.

SUMMARY

An aspect of this document is to provide a liquid crystal display device, which renders video data in accordance with a DRD panel rendering structure without having any line memory, which is a cause of cost increase.

In an aspect, a liquid crystal display device comprises: a liquid crystal display panel having a pixel array comprising a first group of liquid crystal cells connected to odd-numbered gate lines and a second group of liquid crystal cells connected to even-numbered gate lines, wherein each liquid crystal cell of the second group is configured to share data lines with one liquid crystal cell of the first group adjacent to the liquid crystal cell of the second group in an extension direction of the gate lines; a data driving circuit comprising a latch array, and for driving data lines in a time-division manner; and a timing controller for supplying digital video data and data rendering control signals to the data driving circuit and controlling operation timing of the data driving circuit, wherein the latch array temporally separates the digital video data supplied from the timing controller into first group data to be applied to the liquid crystal cells of the first group and second group data to be applied to the liquid crystal cells of the second group according to the data rendering control signals, and outputs the first group data earlier by about ½ horizontal period than the second group data.

BRIEF DESCRIPTION OF THE DRAWINGS

The implementation of this document will be described in detail with reference to the following drawings in which like numerals refer to like elements.

In the drawings.

DETAILED DESCRIPTION

Hereinafter, exemplary embodiments of the present invention will be described in detail with reference to FIGS. 4 to 10.

Figure 4:
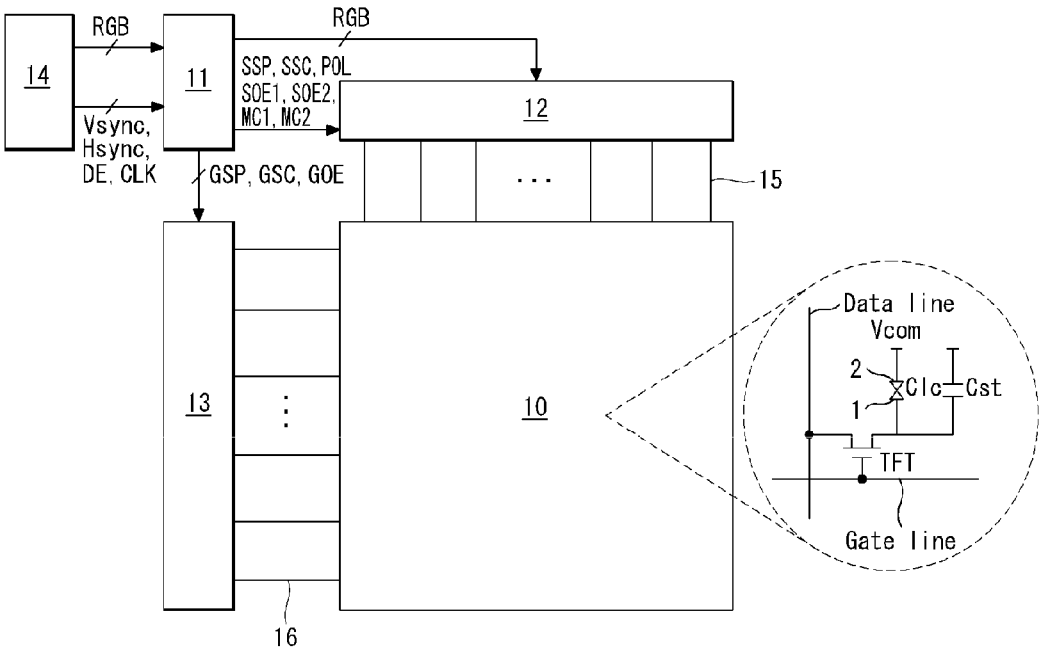
FIG. 4 shows a liquid crystal display device according to an exemplary embodiment of the present invention.

FIG. 4 shows a liquid crystal display device according to an exemplary embodiment of the present invention.

Referring to FIG. 4, the liquid crystal display device according to the exemplary embodiment of the present invention comprises a liquid crystal display panel 10, a timing controller 11, a data driving circuit 12, and a gate driving circuit 13.

The liquid crystal display panel 10 has a liquid crystal layer formed between two glass substrates. The liquid crystal display panel 10 comprises liquid crystal cells Clc disposed in a matrix form defined by data lines 15 and gate lines 16 crossing each other.

Figure 5:
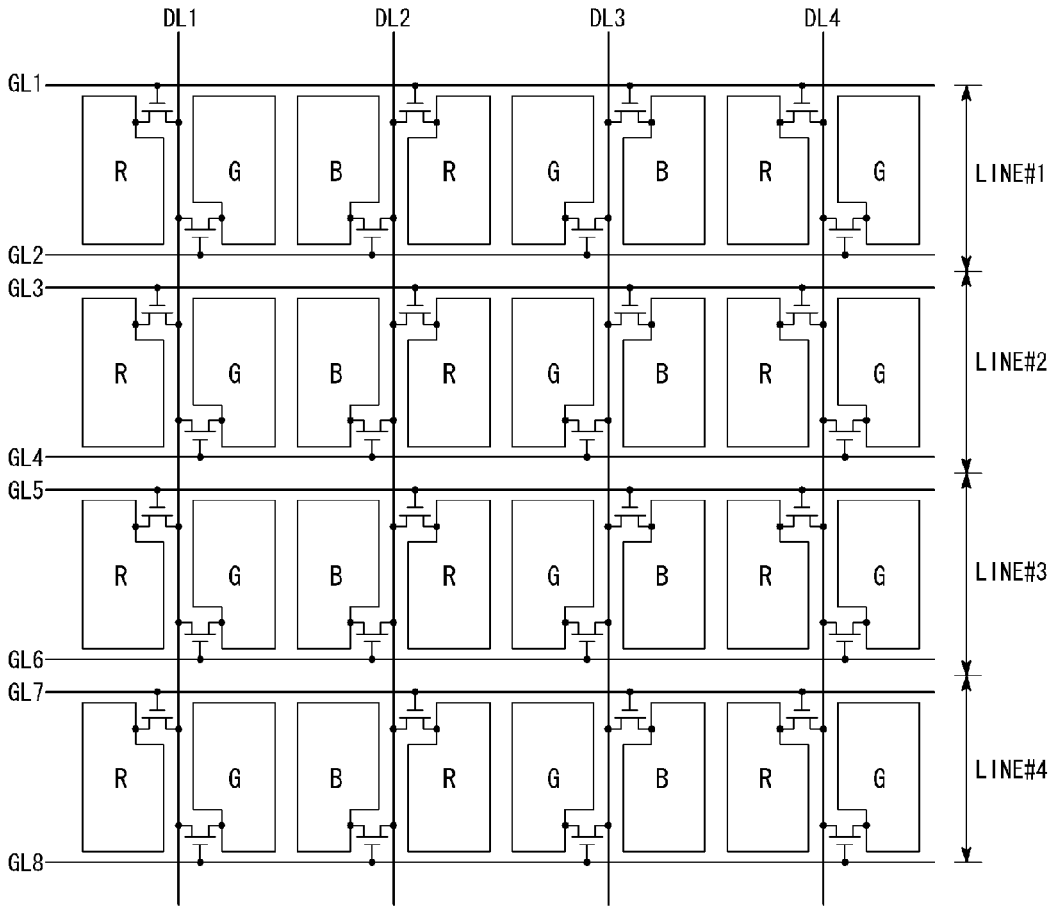
FIG. 5 shows a pixel array of a liquid crystal display panel having a DRD structure.

A pixel array is formed on the lower glass substrate of the liquid crystal display panel 10. The pixel array comprises the liquid crystal cells Clc, TFTs formed at crossings of the data lines 15 and the gate lines 16 and connected to pixel electrodes 1 of the liquid crystal cells, and storage capacitors Cst. The pixel array may be implemented as shown in FIG. 5. The liquid crystal cells Clc are connected to the TFTs and driven by an electric field between the pixel electrodes 1 and a common electrode 2. A black matrix, color filters, etc. are formed on the upper glass substrate of the liquid crystal display panel 10. Polarizers are respectively attached to the upper and lower glass substrates of the liquid crystal display panel 10. An alignment layer for setting a pre-tilt angle of liquid crystal is formed on the upper and lower glass substrates of the liquid crystal display panel 10.

The common electrode 2 is formed on the upper glass substrate in a vertical electric field driving method such as a twisted nematic (TN) mode and a vertical alignment (VA) mode. On the other hand, the common electrode 2 is formed on the lower glass substrate together with the pixel electrode 1 in a horizontal electric field driving method such as an in plane switching (IPS) mode and a fringe field switching (FFS) mode.

The liquid crystal display panel 10 applicable in the present invention may be implemented in any liquid crystal mode, as well as the TN mode, VA mode, IPS mode, and FFS mode. Moreover, the liquid crystal display device of the present invention may be implemented in any form including a transmissive liquid crystal display, a semi-transmissive liquid crystal display, and a reflective liquid crystal display. The transmissive liquid crystal display and the semi-transmissive liquid crystal display require a backlight unit. The backlight unit may be a direct type backlight unit or an edge type backlight unit.

Figure 2:
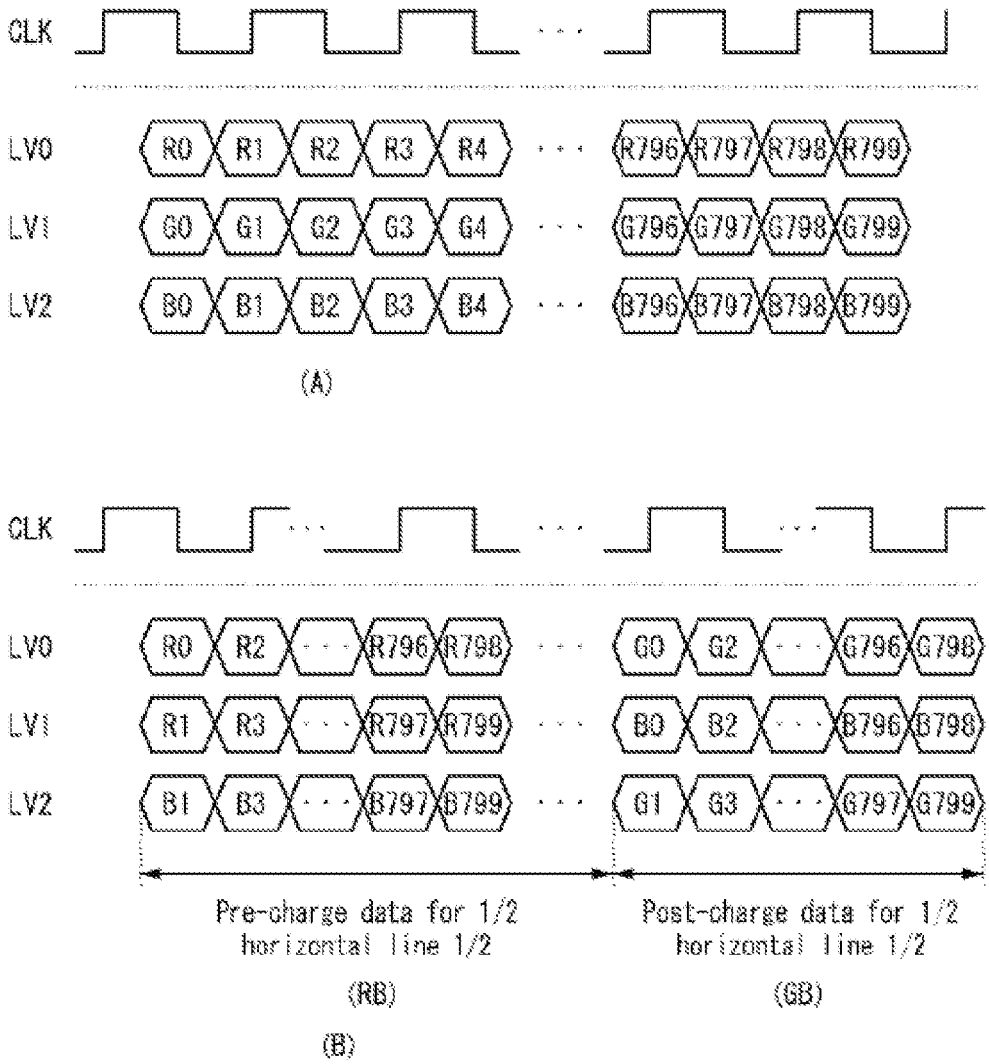
FIG. 2 (RELATED ART)
FIG. 2 is a view showing the alignment sequences of video data in the normal panel and the DRD panel.
Figure 3:
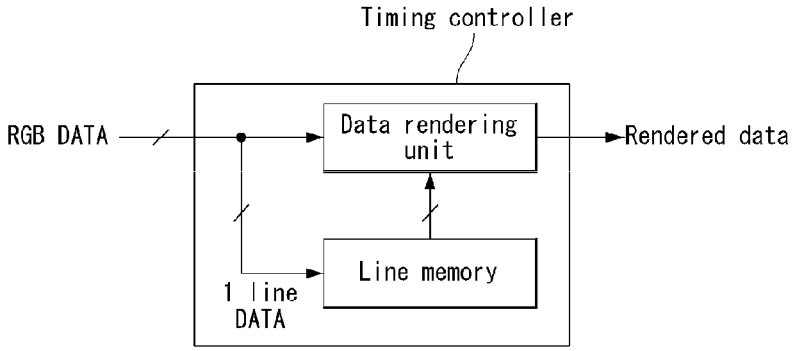
FIG. 3 (RELATED ART)
FIG. 3 is a view showing a timing controller of a conventional liquid crystal display device having a DRD panel.

The timing controller 11 receives digital video data RGB of an input image input from a system board 14 in an LVDS (Low Voltage Differential Signaling) interface manner, and supplies the digital video data RGB of the input image to the data driving circuit 12 in a mini-LVDS interface manner. The timing controller 11 supplies the digital video data RGB input from the system board 14 in the same order as they are received without being aligned in accordance with the rendering structure of the pixel array as shown in FIG. 5. That is, the timing controller 11 outputs the video data for one horizontal line to the data driving circuit 12 in the order of R0, G0, B0, R1, G1, B1, . . . R799, G799, B799 as shown in (A) of FIG. 2.

The timing controller 11 receives timing signals, such as a vertical synchronization signal Vsync, a horizontal synchronization signal Hsync, a data enable signal DE, a dot clock signal CLK, etc from the system board 14 and generates control signals for controlling the operation timing of the data driving circuit 12 and the gate driving circuit 13. The control signals comprise a gate timing control signal for controlling the operation timing of the gate driving circuit 13 and a data timing control signal for controlling the operation timing of the data driving circuit 12 and the vertical polarity of a data voltage. The timing controller 11 is able to multiply the frequency of the gate timing control signal and the frequency of the data timing control signal by a frame frequency of (60×i, wherein i is the number of color in each pixel) Hz so that the digital video data input at a frame frequency of 60 Hz can be displayed at a frame frequency of (60×i) Hz by the pixel array of the liquid crystal display panel 10.

The gate timing control signal comprises a gate start pulse GSP, a gate shift clock GSC, a gate output enable signal GOE, etc. The gate start pulse GSP is applied to a gate drive IC generating a first gate pulse and controls the gate drive IC so as to generate the first gate pulse. The gate shift clock GSC is a clock signal commonly input to the gate drive ICs and a clock signal for shifting the gate start pulse GSP. The gate output enable signal GOE controls an output of the gate drive ICs.

Figure 7:
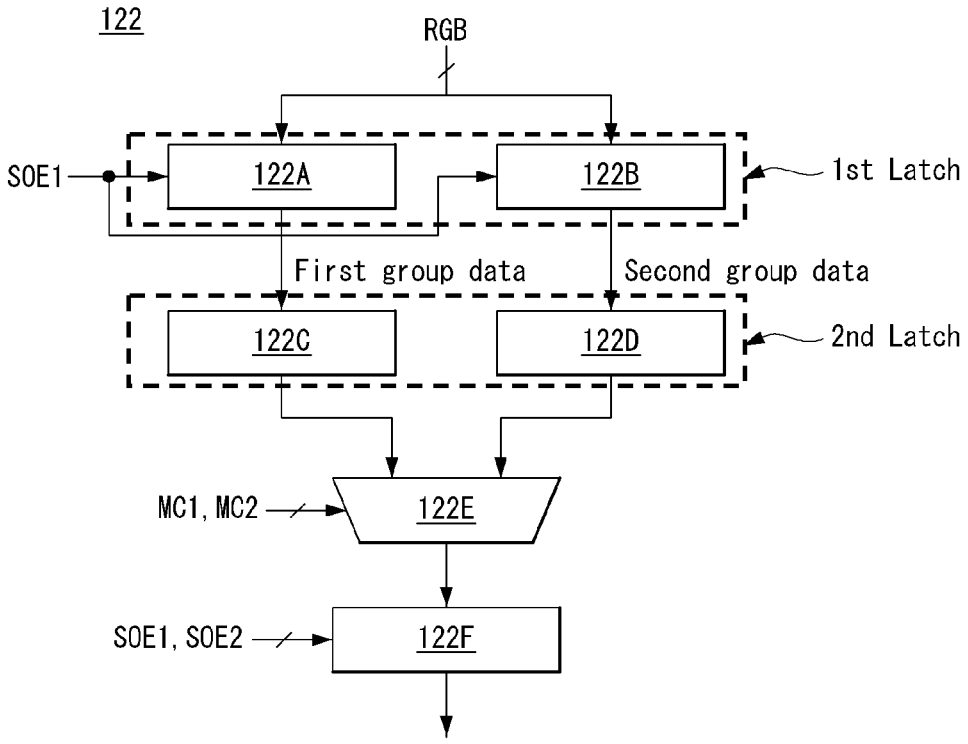
FIG. 7 shows a detailed configuration of a latch array capable of rendering data.

The data timing control signal comprises a source start pulse SSP, a source sampling clock SSC, a vertical polarity control signal POL, a horizontal polarity control signal HINV, a source output enable signal SOE, etc. The source start pulse SSP controls a data sampling start timing of the data driving circuit 12. The source sampling clock SSC is a clock signal for controlling a sampling timing of data in the data driving circuit 12 based on a rising or falling edge. The vertical polarity control signal POL controls the vertical polarity of data voltages sequentially output from each of the source drive ICs. The source output enable signal SOE controls an output timing of the data driving circuit 12. The source output enable signal SOE comprises a first source output enable signal SOE1 and a second source output enable signal SOE2. The first source output enable signal SOE1 controls an output timing of data to be applied to the liquid crystal cells connected to the odd-numbered gate lines GL1, GL3, GL5, and GL7 in the pixel array of FIG. 5, and the second source output enable signal SOE2 controls an output timing of data to be applied to the liquid crystal cells connected to the even-numbered gate lines GL2, GL4, GL6, and GL8 in the pixel array of FIG. 5. MUX control signals MC1 and MC2 controls an output operation of a multiplexer 122E included in the data driving circuit 12 as shown in FIG. 7. The source output enable signals SOE1 and SOE2 and the MUX control signals MC1 and MC2 function as data rendering control signals.

The data driving circuit 12 may comprise a plurality of source drive ICs (Integrated Circuits). Each of the source drive ICs of the data driving circuit 12 comprises a shift register, a latch array, a digital-to-analog converter, an output circuit, etc. The data driving circuit 12 latches the digital video data RGB in response to a data timing control signal, and then converts the latched data into analog positive and negative gamma compensation voltages and outputs data voltages, whose polarities are inverted every predetermined cycle, to the data lines 15.

In particular, the data driving circuit 12 performs data rendering in accordance with the rendering structure of the pixel array as shown in FIG. 5 by changing the latch array. Hence, a line memory can be omitted from the timing controller 11.

The gate driving circuit 13 may comprise a plurality of gate drive ICs. The gate driving circuit 13 sequentially supplies gate pulses to the gate lines 16 in response to gate timing control signals by using a shift register and a level shifter. The shift register of the gate driving circuit 13 may be directly formed on the lower glass substrate through a Gate In Panel (GIP) process.

FIG. 5 shows the pixel array of the liquid crystal display panel 10 having a DRD structure.

Referring to FIG. 5, in this pixel array, red liquid crystal cells, to which red data (R) is applied, green liquid crystal cells, to which green data (G) is applied, and blue liquid crystal cells, to which blue data (B) is applied, are respectively arranged along a row direction. In the pixel array, 1 pixel comprises a red liquid crystal cell, a green liquid crystal cell, and a blue liquid crystal cell that are adjacent in a row direction crossing the column direction. The liquid crystal cells adjacent in the left and right direction (i.e., the extension direction of the gate lines 16) in the pixel array share the same data lines, and are continually charged with data voltages supplied in a time-division manner through the data lines.

To this end, a pair of liquid crystal cells sharing the same data lines is respectively connected to adjacent gate lines. All the red liquid crystal cells among the liquid crystal cells disposed in horizontal lines LINE#1 to LINE#4 are connected to the odd-numbered gate lines GL1, GL3, GL5, and GL7, and all the green liquid crystal cells among the liquid crystal cells disposed in the horizontal lines LINE#1 to LINE#4 are connected to the even-numbered gate lines GL2, GL4, GL6, and GL8. One half of the blue liquid crystal cells among the liquid crystal cells disposed in the horizontal lines LINE#1 to LINE#4 are connected to the odd-numbered gate lines GL1, GL3, GL5, and GL7, and the other half thereof are connected to the even-numbered gate lines GL2, GL4, GL6, and GL8. Hereinafter, for the convenience of explanation, the liquid crystal cells connected to the odd-numbered gate lines GL1, GL3, GL5, and GL7 are referred to as a first group of liquid crystal cells, and the liquid crystal cells connected to the odd-numbered gate lines GL2, GL4, GL6, and GL8 and sharing the data lines with the liquid crystal cells of the first group adjacent in the left and right direction are referred to as a second group of liquid crystal cells.

Figure 1:
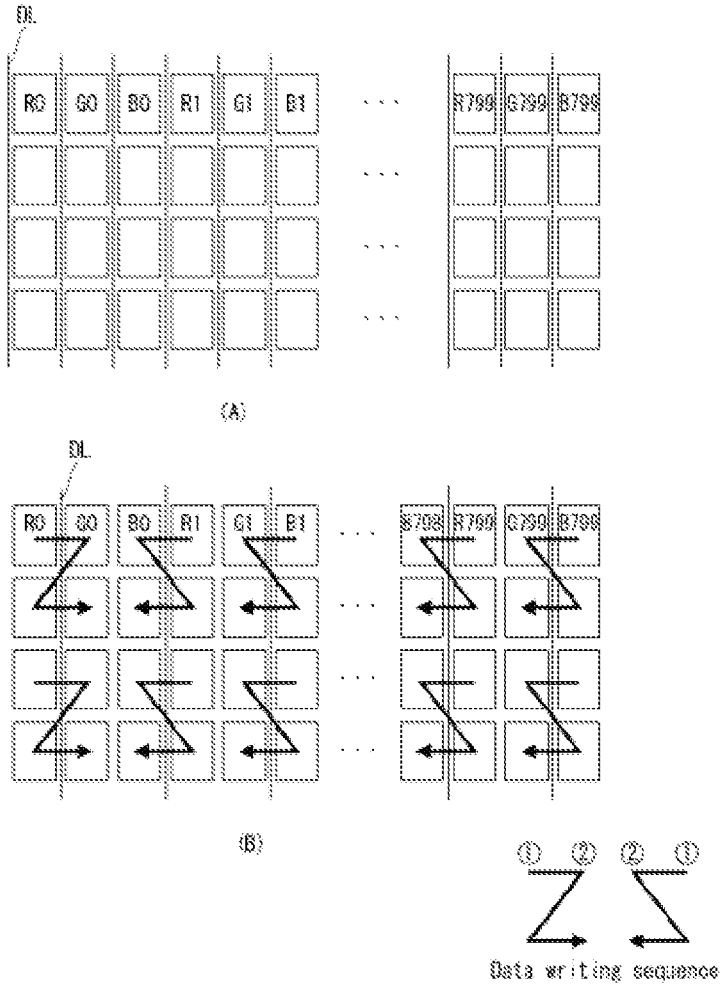
FIG. 1 (RELATED ART)
FIG. 1 is a view showing the comparison between a typical normal panel and a double rate driving (DRD) panel for reducing the number of output channels.

The liquid crystal cells of the first group in the k-th (k is a positive integer) horizontal line are charged with pre-charge data for ½ horizontal line written in the order of ① shown in (B) of FIG. 1 during the first half of 1 horizontal period when the odd-numbered gate lines to which those liquid crystal cells are connected are activated. The liquid crystal cells of the second group in the k-th horizontal line are charged with post-charge data for ½ horizontal line written in the order of ② shown in (B) of FIG. 1 during the second half of the horizontal period when the even-numbered gate lines to which those liquid crystal cells are connected are activated. Hereinafter, for the convenience of explanation, the pre-charge data is referred to as first group data, and the post-charge data is referred to as second group data.

Figure 6:
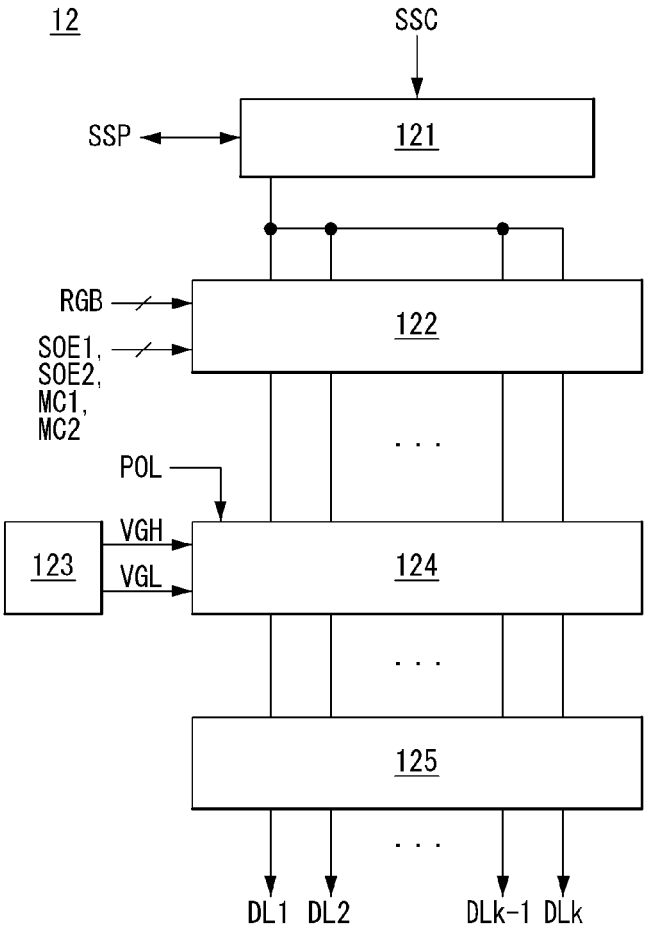
FIG. 6 shows a schematic configuration of a data driving circuit.

FIG. 6 shows a schematic configuration of the data driving circuit 12.

Referring to FIG. 6, the data driving circuit 12 comprises a shift register 121, a latch array 122, a gamma compensation voltage generator 123, a digital-to-analog converter (hereinafter, "DAC") 124, and output circuit 125.

The shift register 121 shifts a sampling signal according to the source sampling clock SSC.

The latch array 122 samples digital video data RGB from the timing controller 11 in response to the sampling signal sequentially input from the shift register 121, latches the data RGB corresponding to every horizontal line, and performs data rendering in accordance with the rendering structure of the pixel array shown in FIG. 5. For data rendering, the latch array 122 temporally separates the first group data to be applied to the liquid crystal cells of the first group and the second group data to be applied to the liquid crystal cells of the second group according to the data rendering control signals input from the timing controller 11, and outputs the first group data earlier by about ½ horizontal period than the second group data. That is, the first group data is outputted in the pre-half of one horizontal period and the second group data is outputted in the post-half of one horizontal period.

The gamma compensated voltage generator 123 segments a plurality of gamma reference voltages into voltages as many as the number of gradations that can be represented by the number of bits of the digital video data RGB to generate positive gamma compensation voltages VGH and negative gamma compensation voltages VGL corresponding to the respective gradations.

The DAC 124 includes a P-decoder to which the positive gamma compensation voltages VGH are supplied, an N-decoder to which the negative gamma compensation voltages VGL are provided, and a selector for selecting one of an output of the P-decoder and an output of the N-decoder in response to the polarity control signal POL. The P-decoder decodes the first and second group data input from the latch array 122 and outputs a positive gamma compensation voltage VGH corresponding to the gradation of the data. The N-decoder decodes the first and second group data input from the latch array 122 and outputs a negative gamma compensation voltage VGH corresponding to the gradation of the data. The selector selects one of a positive gamma compensation voltage VGH and a negative gamma compensation voltage VGL in response to the polarity control signal POL.

The output circuit 125 includes a plurality of buffers respectively connected to output channels. The output circuit 125 minimizes signal attenuation of analog data voltages supplied from the DAC 124, and then supplies the analog data voltages to the data lines DL1 to DLk of the liquid crystal display panel.

Figure 8:
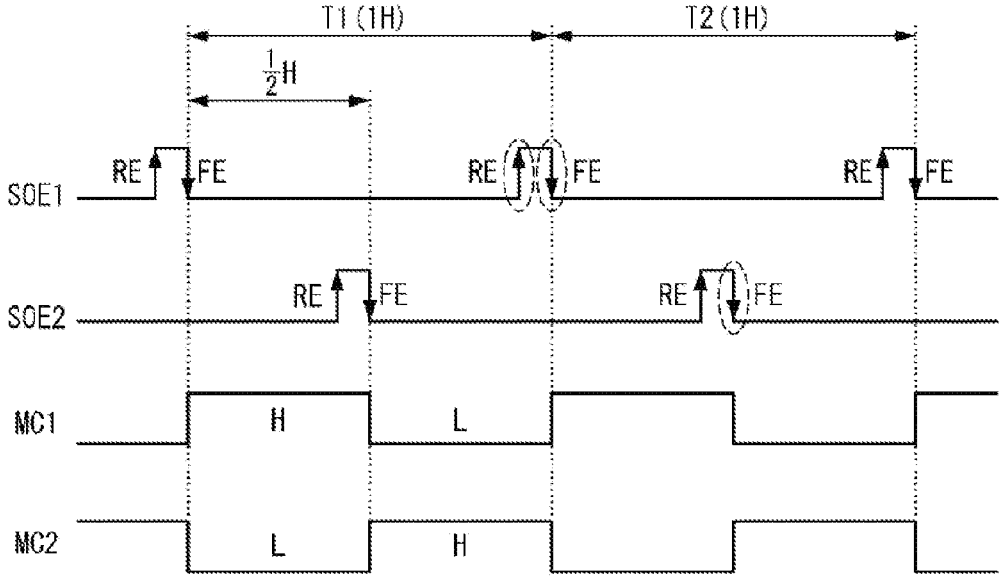
FIG. 8 shows control timings of the data rendering control signals.

FIG. 7 shows a detailed configuration of the latch array 122 capable of rendering data. FIG. 8 shows control timings of a first source output enable signal SOE1, a second source output enable signal SOE2, a first MUX control signal MC1, and a second MUX control signal MC2, as the data rendering control signals.

Referring to FIG. 7, the latch array 122 comprises a first latch having a 1-1th latch 122A and a 1-2th latch 122B, a second latch having a 2-1th latch 122C and a 2-2th latch 122D, a multiplexer 122E, and a third latch 122F.

Referring to FIG. 8, a first period T1 and a second period T2 that correspond to 1 horizontal period 1H are defined by adjacent falling edges FE of the first source output enable signal SOE1. The second source output enable signal SOE2 is generated later by ½ horizontal period H/2 than the first source output enable signal SOE1. The first MUX control signal MC1 is generated as a high logic H for the first half H/2 of the horizontal period 1H and as a low logic L for the second half H/2 of the horizontal period 1H. The second MUX control signal MC2 is generated as a logic opposite to that of the first MUX control signal MC1. That is, the second MUX control signal MC2 is generated as a low logic L for the first half H/2 of the horizontal period 1H and as a high logic H for the second half horizontal period H/2 of the horizontal period 1H. The first MUX control signal MC1 and the second MUX control signal MC2 are used to control the output operation of the multiplexer 122E.

During the first period T1, the 1-1th latch 122A sequentially latches the first group data among the input digital video data RGB corresponding to 1 horizontal line, and the 1-2th latch 122B sequentially latches the second group data among the input digital video data RGB corresponding to 1 horizontal line. At a rising edge RE of the first source output enable signal SOE1 included in the first period T1, the 1-1th latch 122A outputs the latched first group data to the 2-1th latch 122C, and at the same time the 1-2th latch 122B outputs the latched second group data to the 2-2th latch 122D.

The multiplexer 122E electrically connects the 2-1th latch 122C and the third latch 122F during the first half horizontal period H/2 of the second period T2 in response to the first MUX control signal MC1. Also, the multiplexer 122E electrically connects the 2-2th latch 122D and the third latch 122F during the second half horizontal period H/2 of the second period T2 in response to the second MUX control signal MC2.

The third latch 122F outputs the first group data input from the 2-1th latch 122C to the DAC 124 through the multiplexer 122E during the first half horizontal period H/2 of the second period T2 starting from a falling edge FE of the first source output enable signal SOE1. Also, the third latch 122F outputs the second group data input from the 2-2th latch 122D to the DAC 124 through the multiplexer 122E during the second half horizontal period H/2 of the second period T2 starting from the falling edge FE of the second source output enable signal SOE2. The 2-2th latch 122D holds the second group data during the first half horizontal period H/2 of the second period T2 so that the second group data is output later by ½ horizontal period H/2 than the first group data.

In this way, the present invention implements the functions of a conventional line memory by means of the second latch 122C and 122D. The latch array 122 comprising the second latch 122C and 122D comprises flip-flops which are cheaper than the line memory. Hence, the present invention can greatly reduce costs compared to the prior art.

Figure 9:
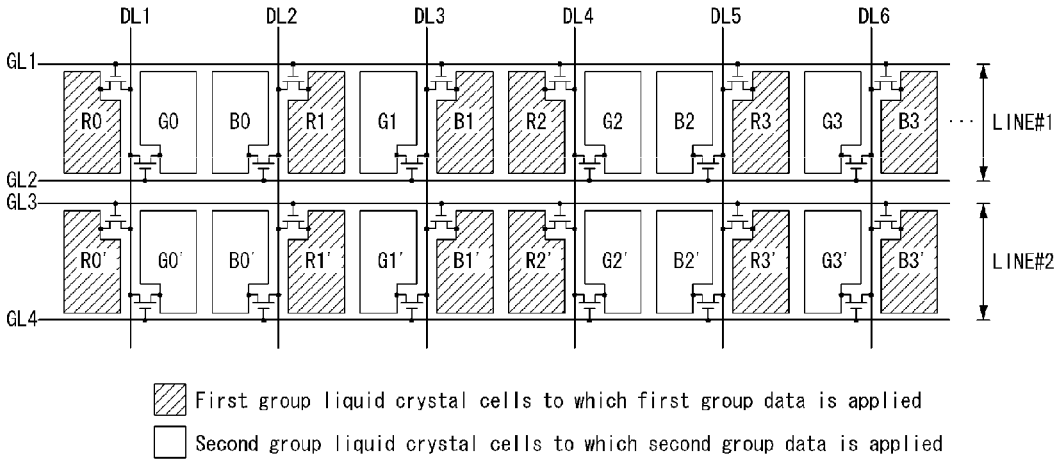
FIGS. 9 and 10 are views showing an example in which data rendering is performed in the latch array.
Figure 10:
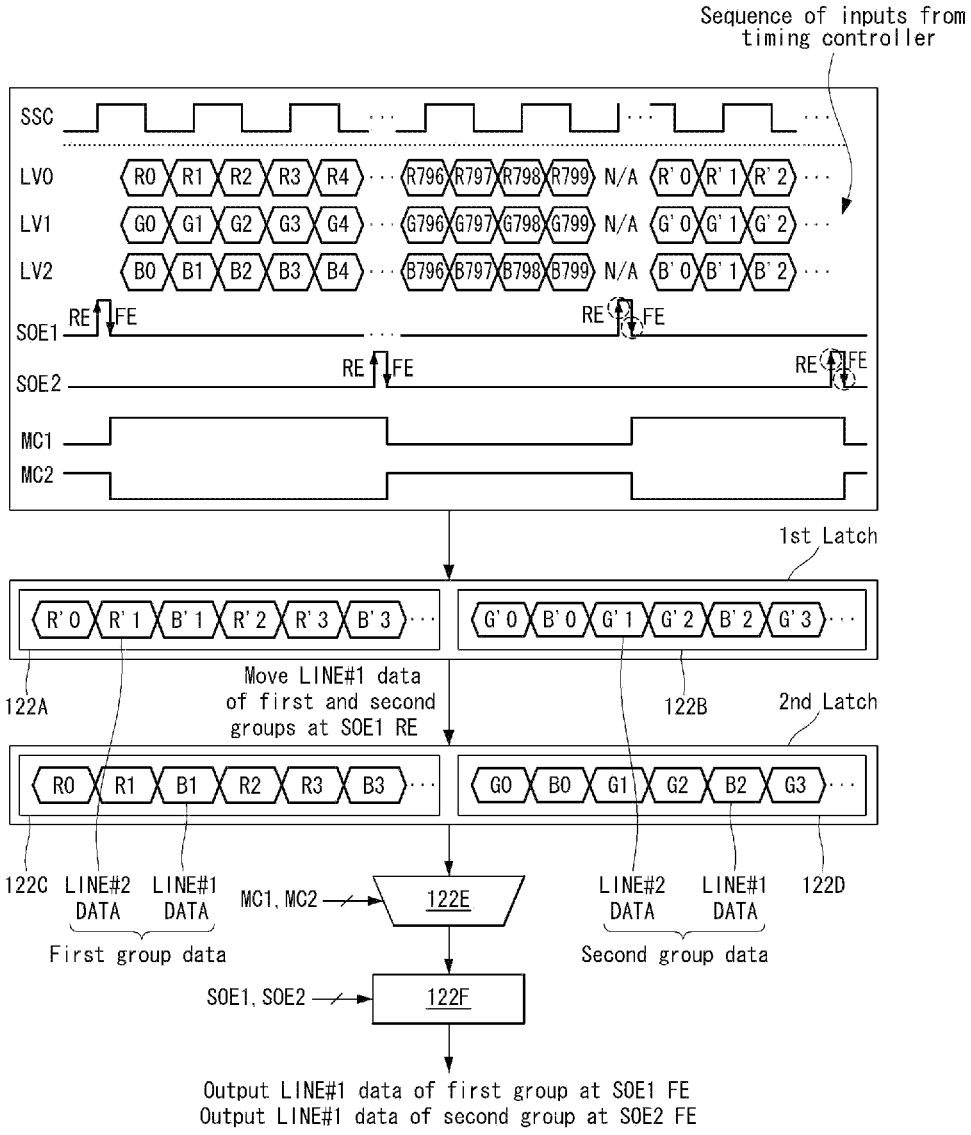

FIGS. 9 and 10 show an example in which data rendering is performed in the latch array.

Referring to FIGS. 9 and 10, taken in conjunction with FIGS. 7 and 8, description will now be given on how data to be applied to the first horizontal line LINE#1 and data to be applied to the second horizontal line LINE#2 are actually stored in the latch array 122 and output therefrom, as an example of how data to be applied to every horizontal line is actually stored in the latch array 122 and output therefrom.

The data to be applied to the first horizontal line LINE#1 and the data to be applied to the second horizontal line LINE#2 are input to the latch array 122 without any alignment process in the timing controller. That is, the data to be applied to the first horizontal line LINE#1 is input to the latch array 122 in the order of R0, G0, B0, . . . R799, G799, B799, and the data to be applied to the second horizontal line LINE#2 is input to the latch array 122 in the order of R'0, G'0, B'0, . . . R'799, G'799, B'799.

During the first period T1, the 1-1th latch 122A sequentially latches the first group data R0, R1, B1, R2, R3, B3, . . . R799, B799 among the data R0, G0, B0, . . . R799, G799, B799 corresponding to 1 horizontal line to be applied to the first horizontal line LINE#1, and the 1-2th latch 122B sequentially latches the second group data G0, B0, G1, G2, B2, G3, . . . G799 among the data R0, G0, B0, . . . R799, G799, B799 corresponding to 1 horizontal line to be applied to the first horizontal line LINE#1. At a rising edge RE of the first source output enable signal SOE1 included in the first period T1, the 1-1th latch 122A outputs the latched first group data R0, R1, B1, R2, R3, B3, . . . R799, B799 to the 2-1th latch 122C, and at the same time the 1-2th latch 122B outputs the latched second group data G0, B0, G1, G2, B2, G3, . . . G799 to the 2-2th latch 122D.

Afterwards, during the second period T2, the 1-1th latch 122A sequentially latches the first group data R'0, R'1, B'1, R'2, R'3, B'3, . . . R'799, B'799 among the data R'0, G'0, B'0, . . . R'799, G'799, B'799 corresponding to 1 horizontal line to be applied to the second horizontal line LINE#2, and the 1-2th latch 122B sequentially latches the second group data G'0, B'0, G'1, G'2, B'2, G'3, . . . G'799 among the data R'0, G'0, B'0, . . . R'799, G'799, B'799 corresponding to 1 horizontal line to be applied to the second horizontal line LINE#2.

The multiplexer 122E electrically connects the 2-1th latch 122C and the third latch 122F during the first half horizontal period H/2 of the second period T2 in response to the first MUX control signal MC1. Also, the multiplexer 122E electrically connects the 2-2th latch 122D and the third latch 122F during the second half horizontal period H/2 of the second period T2 in response to the second MUX control signal MC2.

The third latch 122F outputs the first group data R0, R1, B1, R2, R3, B3, . . . R799, B799 input from the 2-1th latch 122C to the DAC 124 through the multiplexer 122E during the first half horizontal period H/2 of the second period T2 starting from the falling edge FE of the first source output enable signal SOE1. Also, the third latch 122F outputs the second group data G0, B0, G1, G2, B2, G3, . . . G799 input from the 2-2th latch 122D to the DAC 124 through the multiplexer 122E during the second half horizontal period H/2 of the second period T2 starting from the falling edge FE of the second source output enable signal SOE2.

As discussed above, the liquid crystal display device according to the present invention can omit a line memory, which is a cause of cost increase, from the timing controller and significantly increase cost competitiveness by adding latches, which are relatively cheap, to correspond to the DRD panel rendering structure and performing rendering, which has been conventionally performed in the timing controller, in the latch array of the data driving circuit.

From the foregoing description, those skilled in the art will readily appreciate that various changes and modifications can be made without departing from the technical idea of the present invention. Therefore, the technical scope of the present invention is not limited to the contents described in the detailed description of the specification but defined by the appended claims.

What is claimed is:

1. A liquid crystal display device comprising:

a liquid crystal display panel having a pixel array comprising a first group of liquid crystal cells connected to odd-numbered gate lines and a second group of liquid crystal cells connected to even-numbered gate lines, wherein each liquid crystal cell of the second group is configured to share data lines with one liquid crystal cell of the first group adjacent to the liquid crystal cell of the second group in an extension direction of the gate lines;

a data driving circuit comprising a latch array, and for driving data lines in a time-division manner; and a timing controller for supplying digital video data and data rendering control signals to the data driving circuit and controlling operation timing of the data driving circuit, wherein the latch array temporally separates the digital video data supplied from the timing controller into first group data to be applied to the liquid crystal cells of the first group and second group data to be applied to the liquid crystal cells of the second group according to the data rendering control signals, and outputs the first group data earlier by ½ horizontal period than the second group data, wherein the ½ horizontal period is a first half horizontal period from an falling edge of a first source output enable signal to an falling edge of a second source output enable signal.

2. The liquid crystal display device according to claim 1, wherein the timing controller supplies all digital video data for the liquid crystal cells of the first groups and the second groups in one horizontal line to the data driving circuit every time.

3. The liquid crystal display device according to claim 1, wherein the latch array comprises:

a 1-1 latch for sequentially latches the first group data among the digital video data supplied from the timing control during a period starting from the falling edge of the first source output enable signal to a rising edge of the first source output enable signal next to the falling edge of the first source output enable signal and outputting the latched first group data in response to the rising edge of first source output enable signal;

a 1-2 latch for sequentially latches the second group data among the digital video data supplied from the timing control during the period starting from the falling edge of the first source output enable signal to the rising edge of the first source output enable signal next to the falling edge of the first source output enable signal and outputting the latched second group data in response to the rising edge of first source output enable signal;

a 2-1 latch for latching the outputted first group data from the 1-1 latch in response to the rising edge of the first source output enable signal; and a 2-2 latch for latching the outputted second group data from the 1-2 latch in response to the rising edge of the first source output enable signal.

4. The liquid crystal display device according to claim 3, wherein the latch array comprising:

a multiplexer for selecting and outputting one of the first group data outputted from the 2-1 latch and the second group data outputted from the 2-2 latch in response to a first MUX control signal and a second MUX control signal included in the data rendering control signals;

a output latch for outputting the one of the first group data and the second group data selected and outputted by the multiplexer according to a first source output enable signal and a second source output enable signal included in the data rendering control signals.

5. The liquid crystal display device according to claim 4, wherein the first MUX control signal has a high logic in a first half horizontal period of one horizontal period and has a low logic in a second half horizontal period of the one horizontal period, which is later by ½ horizontal period than the first half horizontal period, and the second MUX control signal has an opposite logic to the first MUX control signal.

6. The liquid crystal display device according to claim 5, wherein the multiplexer selects the first group data and outputs it to the output latch when the first MUX control signal has the high logic, and selects the second group data and outputs it to the output latch when the second MUX control signal has the high logic.

7. The liquid crystal display device according to claim 5, wherein the second half horizontal period is from the falling edge of the second source output enable signal to the falling edge of the first source output enable signal.

8. The liquid crystal display device according to claim 4, wherein the second source output enable signal is later by ½ horizontal period than the first source output enable signal.

9. The liquid crystal display device according to claim 8, wherein the output latch outputs the first group data in response to the falling edge of the first source output enable signal and outputs the second group data in response to an falling edge of the second source output enable signal.

10. The liquid crystal display device according to claim 4, wherein the multiplexer electrically connects the 2-1 latch and the output latch in response to the first MUX control signal to select and output the first group data; and electrically connects the 2-2 latch and the output latch in response to the second MUX control signal to select and output the second group data.

11. The liquid crystal display device according to claim 1, wherein the latch array is implemented by flip-flop.

12. The liquid crystal display device according to claim 1, wherein the first group of liquid crystal cells includes all red liquid crystal cells and one half of blue liquid crystal cells in one horizontal line of the pixel array; and the second group of liquid crystal cells includes all green liquid crystal cells and another half of blue liquid crystal cells in one horizontal line of the pixel array.

* * * * *